US006196844B1

(12) United States Patent
Bradshaw et al.

(10) Patent No.: US 6,196,844 B1
(45) Date of Patent: Mar. 6, 2001

(54) INTEGRATED TARGET SYSTEM

(76) Inventors: Michael S. Bradshaw, 1302 Kings Crest Dr.; Allen D. Beets, 14 Maple La.; Albert G. Corkery, III, 1061 Lakeview Dr., all of Stafford, VA (US) 22554; Christopher B. Hickman, 202 St. Johns Sq., Sterling, VA (US) 20164

( * ) Notice: Subject to any disclaimer, the term of this patent is extended or adjusted under 35 U.S.C. 154(b) by 0 days.

(21) Appl. No.: 09/026,237

(22) Filed: Feb. 19, 1998

(51) Int. Cl.[7] ..... F41G 3/26

(52) U.S. Cl. ..... 434/21; 434/22; 434/23; 273/371; 273/372; 273/373; 463/2; 463/5; 463/49; 463/51; 463/53; 463/54

(58) Field of Search ..... 463/49–57, 2, 463/5; 434/16–24; 273/371–377, 454–455, 460

(56) References Cited

U.S. PATENT DOCUMENTS 4,340,370 * 7/1982 Marshall et al. ..... 434/22
4,398,722 * 8/1983 Morris et al. ..... 273/310
4,426,085 * 1/1984 Dixon ..... 273/392
4,662,845 * 5/1987 Gallagher et al. ..... 434/22
5,207,579 * 5/1993 Campagnuolo ..... 434/11
5,215,464 * 6/1993 Marshall et al. ..... 434/22
5,320,358 * 6/1994 Jones ..... 273/313
5,403,017 * 4/1995 Doss, III et al. ..... 273/372
5,823,779 * 10/1998 Muehle et al. ..... 434/121

* cited by examiner

*Primary Examiner*—Michael O'Neill
*Assistant Examiner*—Carmen D. White
(74) *Attorney, Agent, or Firm*—Alfred F. Hoyte, Jr.

(57) ABSTRACT

The present invention concerns the integration of laser engagement systems such as the MITS and MILES laser systems with standard two dimensional silhouettes, thereby creating a silhouette which can be defeated by laser fire. A laser enhanced silhouette allows live fire target systems (infantry systems and armor systems) to be engaged and defeated with the use of MILES laser Code. The laser enhanced silhouette replaces the plywood or plastic live fire silhouette which is normally utilized on live fire target systems. By connecting the laser enhanced silhouette electronics to the live fire target system's hit sensor electrical connection, the live fire target system can be engaged by laser equipped weapons.

2 Claims, 8 Drawing Sheets

INTEGRATED TARGET SYSTEM

BACKGROUND OF THE INVENTION

1. Field of the Invention

The present invention relates to target mechanisms. More specifically, it relates to an improved integrated target mechanism.

2. Description of the Prior Art

Live fire target systems use hit (vibration or impact) sensors to detect a live round of ammunition striking a target silhouette. When the hit sensor senses a hit, a switch, which may be either normally closed or normally open, is caused to change state thereby sending a signal to the target lifting mechanism. The target lifting mechanism will receive the signal and lower the target indicating a hit has been recorded. Laser engagement systems use laser sensors to detect engagement by laser equipped weapons. When a hit is detected by a laser engagement system, the equipment emits an audible or visual indication of its condition.

The prior art laser engagement systems, most notably the MITS (Mobile Independent Target System) and MILES (Multiple Integrated Laser Engagement System) require that the system be manually reset by an operator using a controller key after each kill. The controller key fits into a manual locking mechanism which is physically attached to the laser engagement system. By turning the key the operator resets the laser engagement system thereby preparing the system for future engagements. However, the requirement that the system be manually reset is not convenient for use with infantry and armor target mechanisms as it is not feasible to manually reset each target after each hit.

As will be seen, the simplicity and effectiveness of my invention is not rivaled in the prior art.

U.S. Pat. No. 4,437,671 issued to Busch discloses an interactive target system having a plurality of targets. The system is designed with a simplified conductor arrangement to reduce failure due to conductor damage from projectile impact. By contrast the present invention concerns a system for integrating impact sensing target systems with various types of laser fire target systems.

U.S. Pat. No. 4,129,299 issued to Busch discloses a target scoring system for detecting target hits which has an improved sensor arrangement which reduces erroneous hit signals. By contrast, the present invention contemplates a target mechanism which can generate hit signals when hit by simulated (i.e. laser) fire.

U.S. Pat. No. 4,261,579 issued to Bowyer et al. discloses a shock wave target indicating system. The system uses computer controlled targets which may be raised or lowered under computer control. By contrast, the device of the present invention may be used to automatically raise standard targets with relatively minor modifications thereto.

U.S. Pat. No. 4,743,032 issued to Summers et al. discloses a multiple target mechanism which has targets which may be remotely controlled. By contrast, the device of the present invention has a single target mechanism which is automatically raised.

None of the above inventions and patents, taken either singly or in combination, is seen to describe the instant invention as claimed.

SUMMARY OF THE INVENTION

Briefly, the present invention contemplates the integration of laser engagement systems such as the MITS and MILES laser systems with standard two dimensional silhouettes, thereby creating a silhouette which can be defeated by laser fire. A laser enhanced silhouette allows live fire target systems (infantry systems and armor systems) to be engaged and defeated with the use of MILES laser Code. The laser enhanced silhouette replaces the plywood or plastic live fire silhouette which is normally utilized on live fire target systems. By connecting the laser enhanced silhouette's electronics to the live fire target system's hit sensor electrical connection, the live fire target system can be engaged by laser equipped weapons.

Accordingly, it is a principal object of the invention to provide the ability to integrate various systems from different target mechanisms and associated devices to produce a novel and improved automatically resettable target mechanism which may be engaged by simulated fire (i.e. laser fire).

It is a major object of this invention to provide an integrated target system where electronics from existing laser engagement systems can be functionally connected to circuitry associated with existing vibration or hit sensors.

It is another object of the invention to provide such an improved integrated target system where the laser engagement system does not require resetting.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

Figure 1:
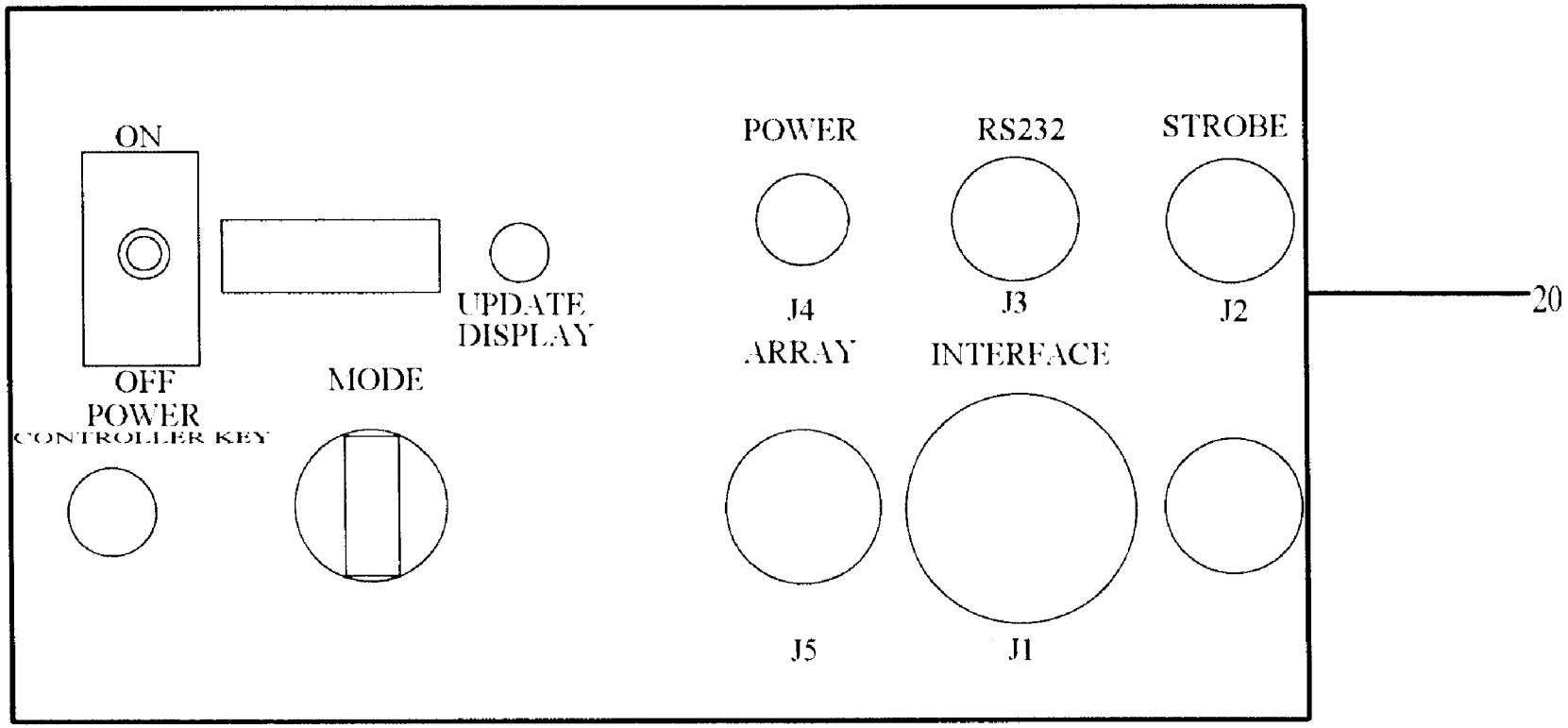
FIG. 1 is a front view of a control box for a standard type of laser engagement system which is modified in accordance with a first embodiment of the present invention.

DETAILED DESCRIPTION OF THE PREFERRED EMBODIMENTS IMPROVED INTEGRATED TARGET SYSTEM

Live fire target systems use hit (vibration or impact) sensors to detect a live round of ammunition striking a target silhouette. When the hit sensor senses a hit, a switch, which may be either normally closed or normally open, is caused to change state thereby sending a signal to the target lifting mechanism. The target lifting mechanism will receive the signal and lower the target indicating a hit has been recorded. Laser engagement systems use laser sensors to detect engagement by laser equipped weapons. When a hit is detected by a laser engagement system, the equipment emits an audible or visual indication of its condition.

The prior art systems, most notably the MITS (Mobile Independent Target System) and MILES (Multiple Integrated Laser Engagement System), require that the system be manually reset by an operator using a controller key after each kill. The controller key fits into a manual locking mechanism which is physically attached to the laser engagement system. By turning the key the operator resets the laser engagement system thereby preparing the system for future engagements.

The present invention contemplates the integration of the MITS and MILES laser systems with standard two dimensional silhouettes, thereby creating a silhouette which can be defeated by laser fire. A Laser Enhanced Silhouette allows live fire target systems such as the Portable Infantry Target System (PITS), DART Target System (DARTS), Enhanced Remote Target System (ERETS), Tank Target Mechanism (TTM), and Armor Moving Target Carrier (AMTC) systems to be engaged and defeated with the use of MILES laser Code. The laser enhanced silhouette (not shown) replaces the plywood or plastic live fire silhouette which is normally utilized on live fire target systems. By connecting the laser enhanced silhouette's electronics to the live fire target system's hit sensor connection, the live fire target system can now be engaged and operated by laser equipped weapons. Further, the laser enhanced silhouette no longer requires the use of the controller key to reset the system after each engagement. The MITS system is reset electronically as the silhouette is restored to the exposed position. The MILES resets electronically after each engagement until a hand held controller tells the lifting mechanism to stop returning to the vertical position. Additionally, it is desirable to have the ability to integrate various systems from different target mechanisms and associated devices to produce a novel and improved automatically resettable target mechanism which may be operable with simulated fire (i.e. laser fire). Also, it is desirable to have the capability of modifying a prior art target mechanism so that it can become "live", i.e., so that it can return simulated weapons fire to the persons who are firing simulated (laser) fire at the target.

There are several types of target systems which may be modified in accordance with the present invention. The Mobile Independent Target System (MITS) is one such system. The MITS is a vehicle mounted laser fire sensing system. The basic equipment consists of an Electronics/ Battery Box (FIG. 1), a MILES (Multiple Integrated Laser Engagement System, as will be explained later) Sensor Array, and a Strobe Light. During normal usage, the electronics box is placed inside a vehicle. The MILES sensor array and the strobe are mounted on the exterior of the vehicle in a readily visible position and attached to their appropriate connectors on the Electronics Box.

When one or more of the MILES Sensors is engaged by the preset MILES laser code from a MILES equipped weapon, the strobe light flashes and the simulated condition of the vehicle (miss, hit, kill) is displayed on the electronics box. After the MITS registers a "Kill", the entire system must be reset by inserting the Controller Key into S2 on the Electronics Box before it can be engaged again. This allows for realistic simulation by effectively removing the "dead" vehicle from any further scenario.

Modified MITS Operational Description

The present invention contemplates a modification of the MITS equipment to allow the vehicle mounted MILES systems to be interfaced with various Remote Target Systems (RETS), Enhanced Remote Target Systems(ERETS) and Tank Target Mechanisms (TTM). These armor target systems provide for range control and status monitoring of range targets which are engaged by the firing of live heavy weapon systems. The modifications allow these target systems to be engaged and defeated by MILES laser code.

Live fire armor targets both stationary and moving, carry two dimensional vehicle silhouettes which depict enemy armor on a armor target lifting mechanism. The target lifting mechanism moves the silhouette from the up (exposed) position, to the down (concealed) position. The target lifting mechanisms are connected to inertia switches known as hit sensors. The hit sensors and target silhouette are mounted on a target lifting mechanism. When a round penetrates the silhouette, vibrations cause the hit sensor to send an electrical signal to the target lifting mechanism, which causes the silhouette to go into the concealed position. When a predetermined number of hits have been registered, the target lifting mechanism will remain in the down/ concealed position.

By connecting a modified MITS to the armored target lifting mechanism's hit sensor jacks, a MILES laser code can now engage and defeat a live fire armor target in the same manner as a live round of heavy ammunition. Our modification also eliminates the need for the MITS to be reset by use of the controller key after each kill. The MITS now resets automatically as the target is restored to the up/exposed position by the RETS/ERETS range software.

Referring now to FIGS. 1–4, all modifications to the MITS gear were done within the electronics/battery box 20 (FIG. 1). The modification consists of the addition of two electronic components making a total of six electrical connections to the printed circuit boards inside the electronics box 20. The two components added to the MITS are, a 12 vdc relay (K1) with both normally open and normally closed contacts, and a position sensitive mercury switch S1*a*.

Each of the two components performs a discreet function. K1 is used to sense and simulate a "Hit" condition in the MITS circuitry and to send that information to the armored target lifting mechanism's hit sensors (not shown). The position sensitive mercury switch S1*a* is used in place of the controller key to reset the MITS system after each kill and concealment.

Figure 2:
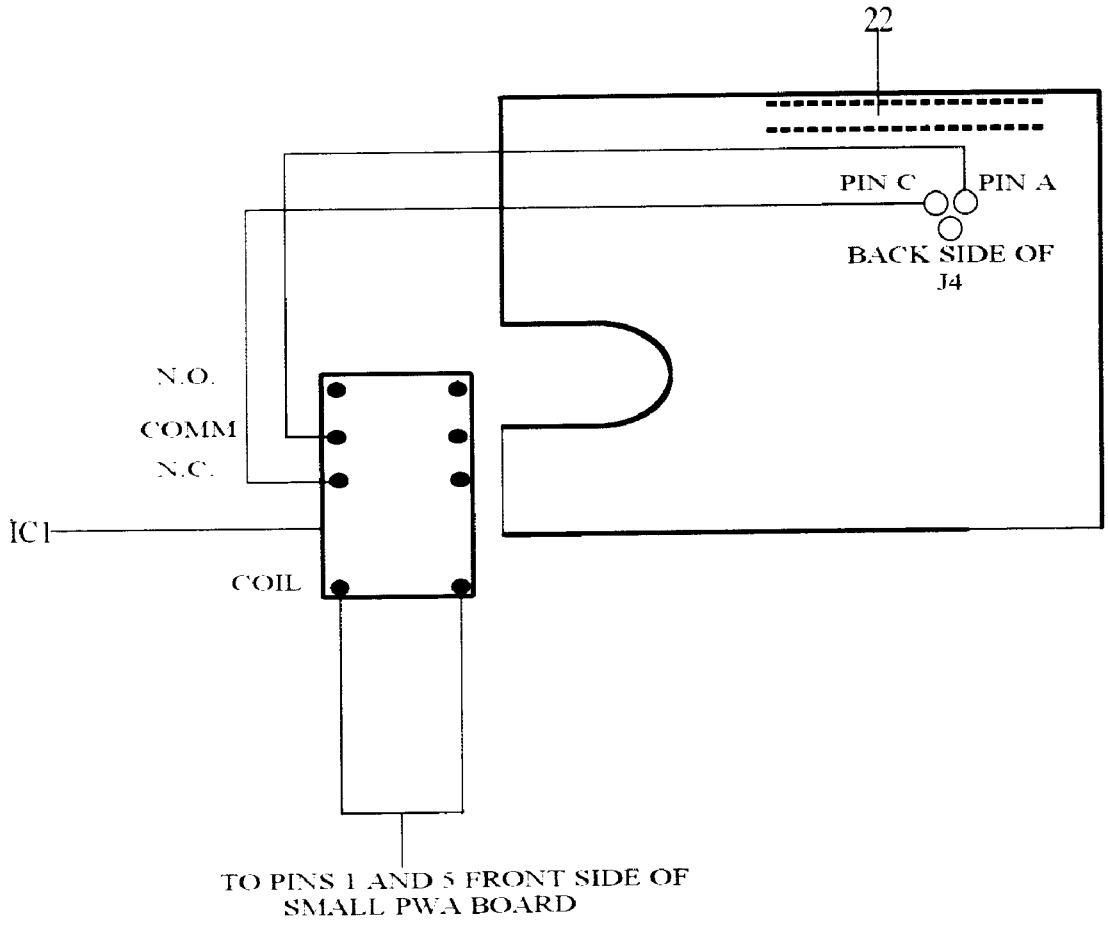
FIG. 2 is a plan view of a first circuit board contained within the control box of FIG. 1.
Figure 3:
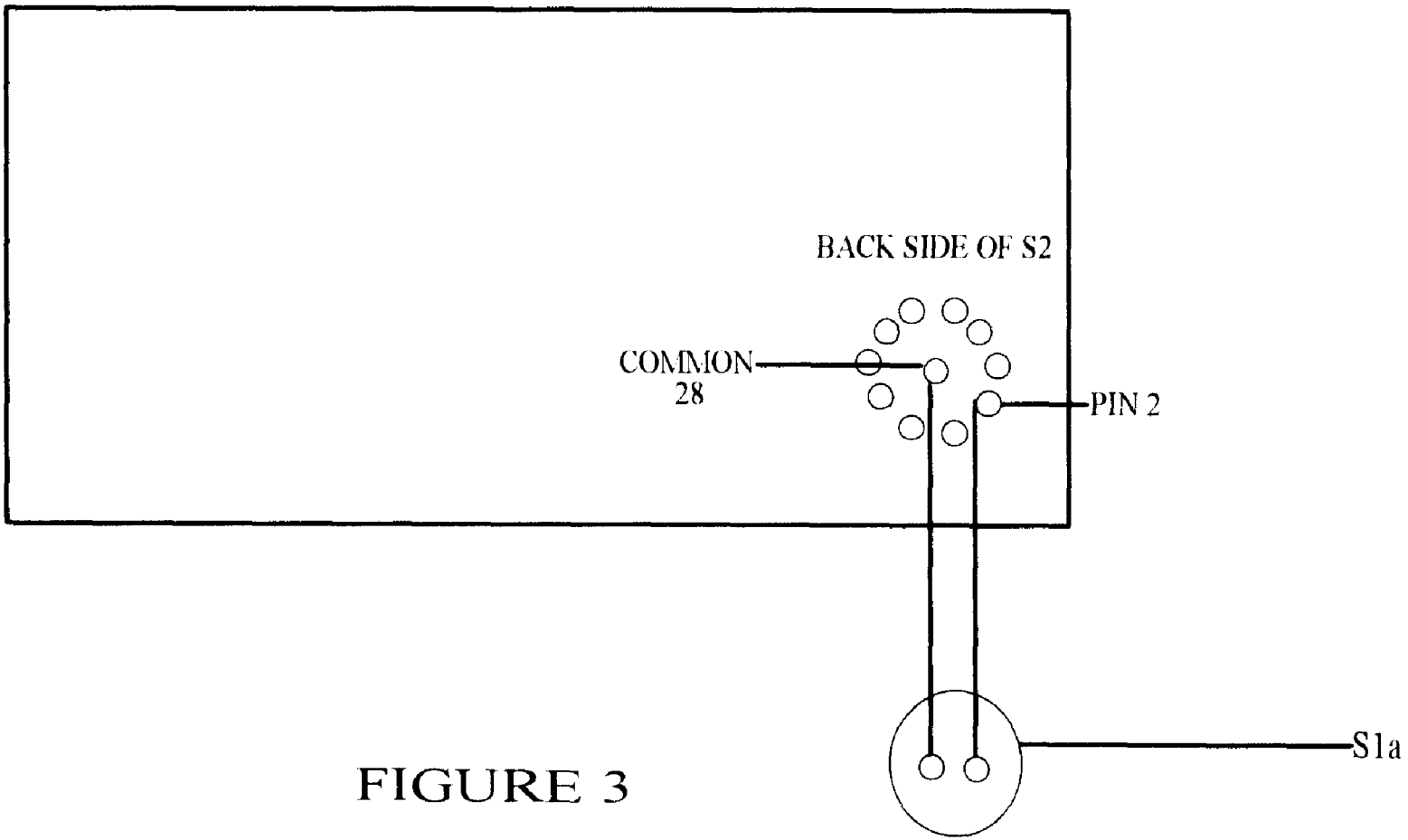
FIG. 3 is a plan view of one side of the main PWA board contained within the control box of FIG. 1.
Figure 4:
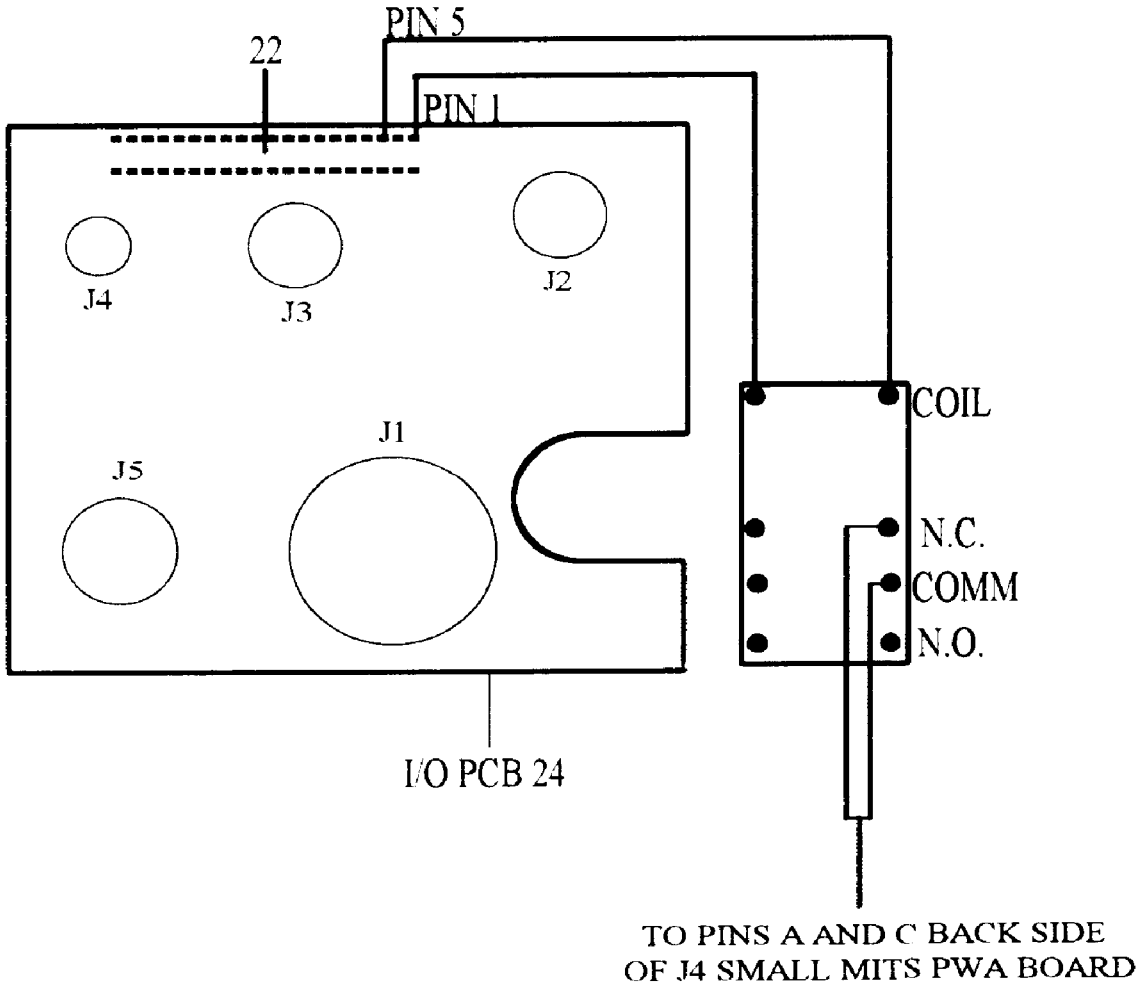
FIG. 4 is a plan view of the front side of the small PWA board contained within the control box of FIG. 1.
Figure 5:
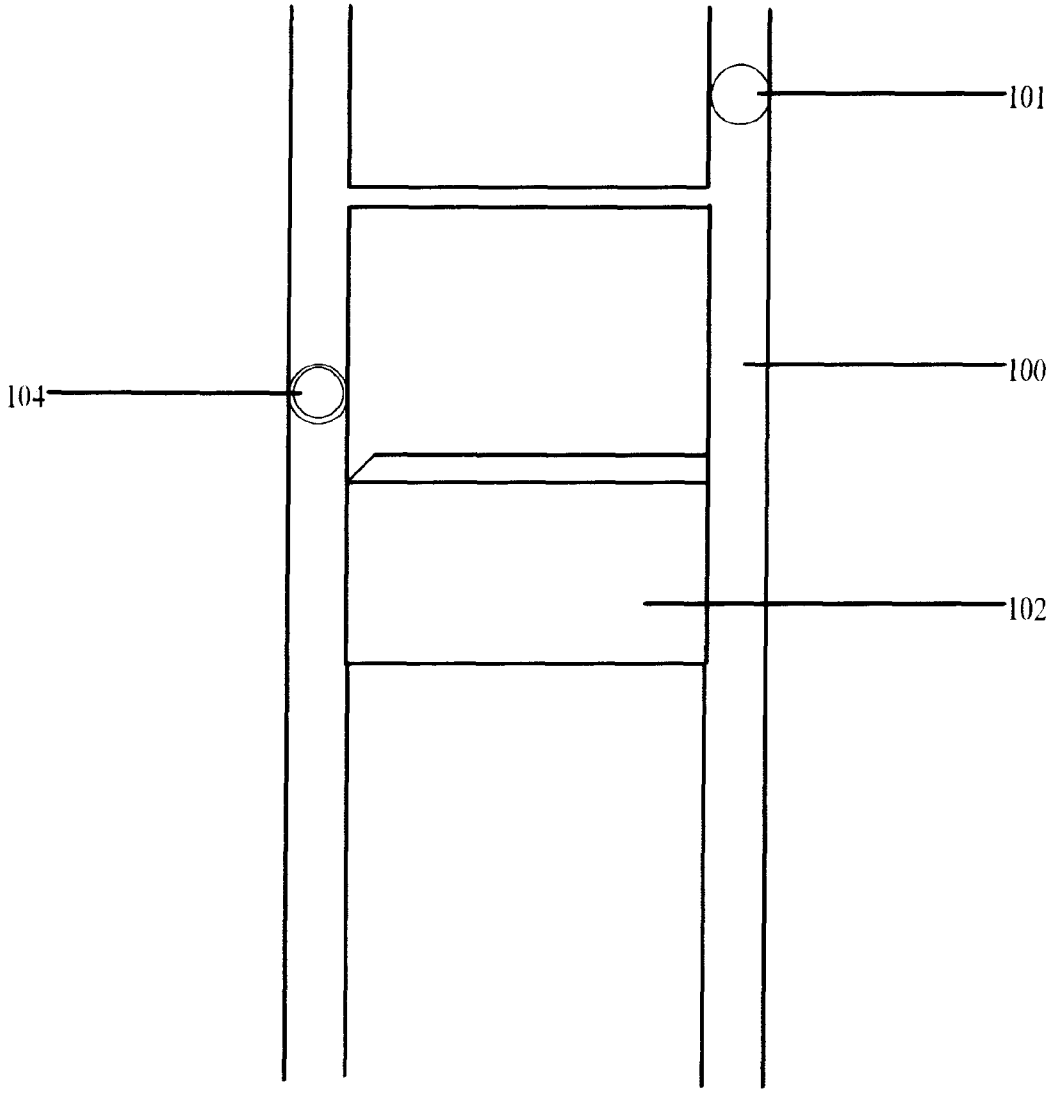
FIG. 5 is a top view of an infantry harness including a control box which is modified in accordance with a second embodiment of the present invention.

The coil of K1 is connected across pins 1&5 of the 50 pin connector 22 which attaches the I/O PCB 24 to the main board PCB (FIG, 3). Under normal conditions the voltage across these pins is 0 vdc. When the MITS senses a "Hit", this voltage rises to 12 vdc and energizes the coil of K1 and opens its normally closed contacts. The opening of these contacts electrically simulates and transmits a "hit" to the armored target's hit sensor connections. These normally closed contacts are connected to pins A and C of connector J4 (FIG. 2). J4 is normally used as a connection for an external power source. For the modification of the present invention, it is used to connect to the armored target lifting mechanism's hit sensor connection (not shown). It can be readily appreciated that the contacts of coil K1 may be normally open thus reversing the previously described response to a "hit", with respect to the switch position.

The position sensitive mercury switch S1*a* is connected across pins 2 and common 28 of S2. The position sensitive mercury switch S1*a* is mounted inside the MITS electronics box 20 in such a manner that its contacts are closed when the box 20 is in the horizontal position and open in the vertical position. The electronics box 20 is secured to the armored target mechanism's target lifting arm (not shown) so that the box 20 is vertical when the target (not shown) is exposed or in the up position. When the target is moved to the concealed or down position as a result of being engaged and defeated by MILES laser code, the armored target mechanism's arm rotates 90 degrees placing the electronics box 20 in the horizontal position. The contacts of S1*a* are now closed. The closed condition of these contacts electrically simulates the turning of the MITS controller key to the reset position. When the target is brought back to the exposed position, the contacts of S1*a* are again opened. This action electrically simulates the turning of the MITS controller key back to the active position. The target may now be engaged repeatedly until the predetermined number of hits is achieved.

It should be noted that all of the modifications may be housed within the electronics box 20.

MILES Gear Operational Description

Referring now to FIGS. 5–8, the modified MILES system is shown. The Multiple Integrated Laser Engagement System (MILES) is best described as "Military Laser Tag". In its most basic form the equipment consists of an infantry harness 100 and a small arms MILES equipped weapon such as an M16, M240G, Viper, etc. The harness 100 has four major components, the MILES sensors 101, the electronics box 102, an annunciator 104, and a controller reset switch 106.

A MILES equipped weapon is one that has been fitted with a laser and fires a predetermined MILES Laser Code in lieu of a live round of ammunition.

When a MILES sensor is struck by MILES Laser Code the annunciator emits a steady audible tone indicating that the wearer of that harness 100 has been "killed". The harness cannot be engaged again until the controller key is inserted into the controller reset switch and turned from the active to the reset position and back to the active position.

Modified MILES Operational Description

The modification of the present invention allows the MILES infantry harness 100 to be interfaced with various Portable Infantry Target Systems such as PITS, DARTS, and ERETS.

The above mentioned targets are electronically controlled target lifting mechanisms which raise and lower two dimensional target silhouettes and provide for five fire engagement and hit registration. The modification allows these portable systems to be engaged and defeated by MILES Laser Code.

Operationally, the radio controlled PITS target lifting mechanism (not shown) moves the silhouette (not shown) from the up (exposed) position, to the down (concealed) position. The target lifting mechanism is connected to an inertia switch/hit sensor (not shown). The hit sensor and target silhouette are mounted on a target holding clamp (not shown). When a round penetrates the silhouette, vibrations cause the hit sensor to send an electrical signal to the target lifting mechanism, which causes the silhouette to go into the concealed position.

The modification of the present invention, when connected to the PITS target's hit sensor jack, allows for MILES equipment to activate the PITS hit sensor in order to conceal the target silhouette and to reset the MILES infantry harness. The modification allows MILES laser code to engage and defeat live fire targets in the same manner as a live round of ammunition. Additionally, this modification eliminates the need for the MILES infantry harness to be reset after each kill. The modification automatically resets the MILES infantry harness after each exposure until the predetermined number of hits (1 to 99) are registered on the target lifting mechanism causing the target lifting mechanism to stop exposing the silhouette.

Figure 6:
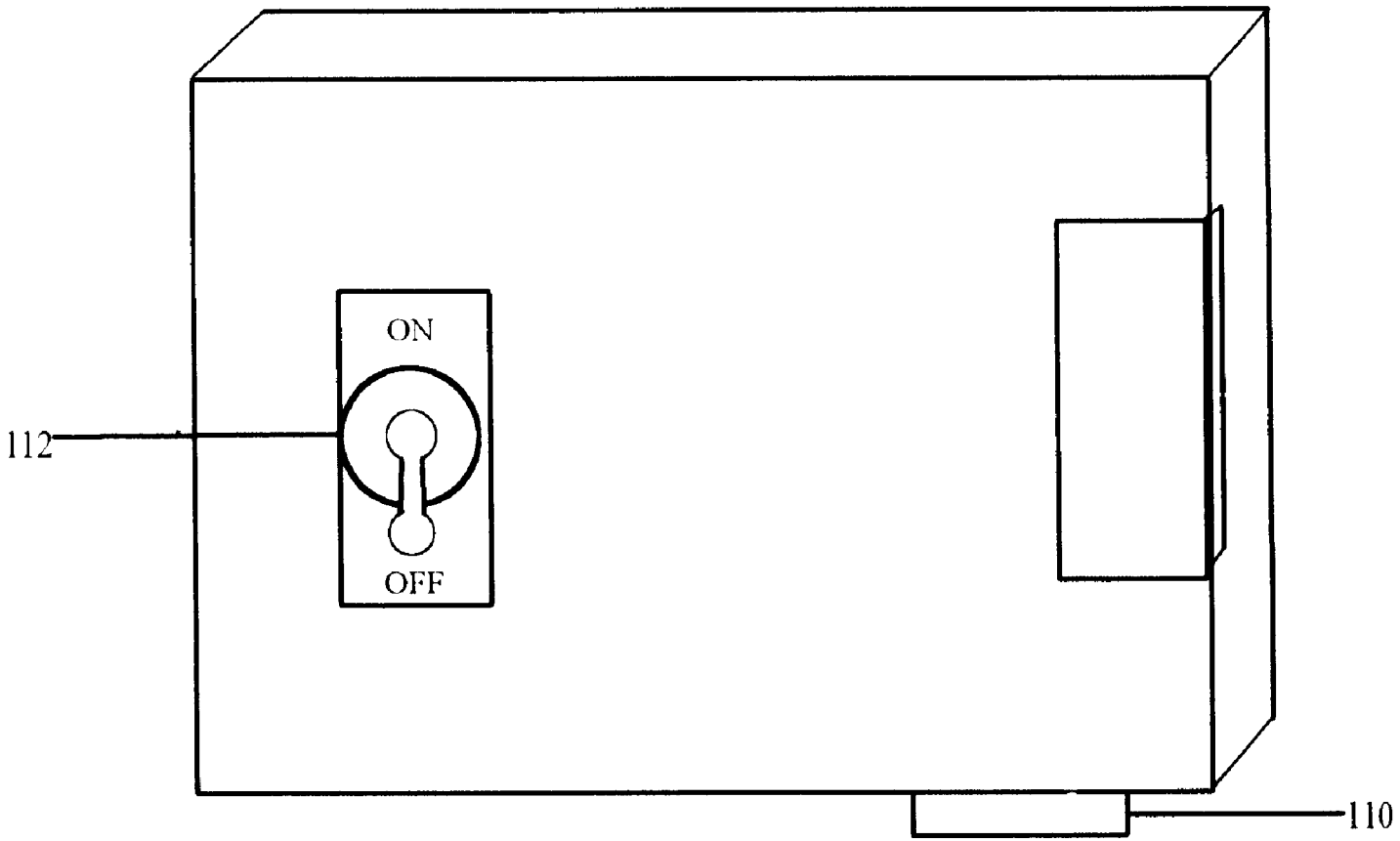
FIG. 6 is a top view of an enclosure which contains the control box of FIG. 5 and additional circuitry in accordance with the present invention.
Figure 7:
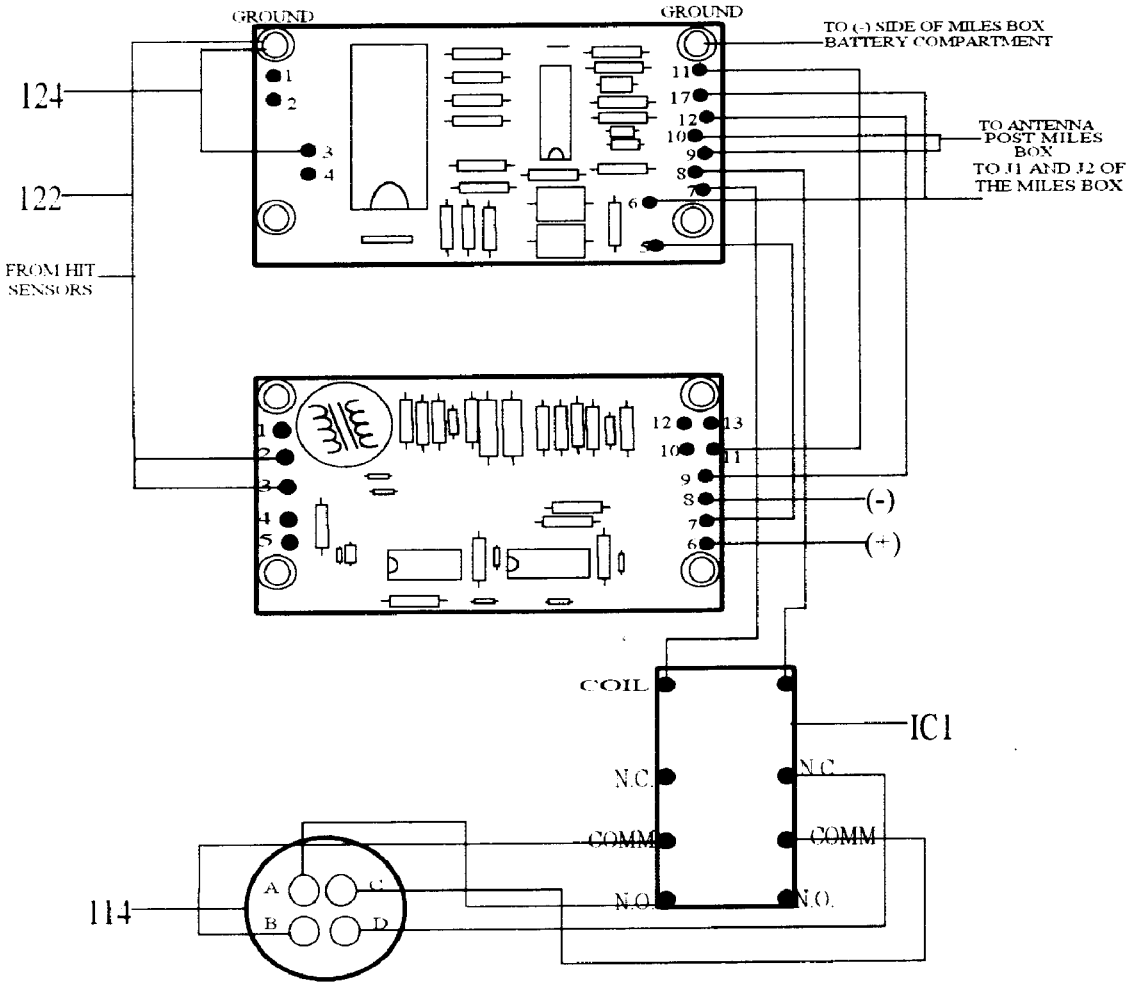
FIG. 7 is a plan view of the circuitry contained within the enclosure of FIG. 6.
Figure 8:
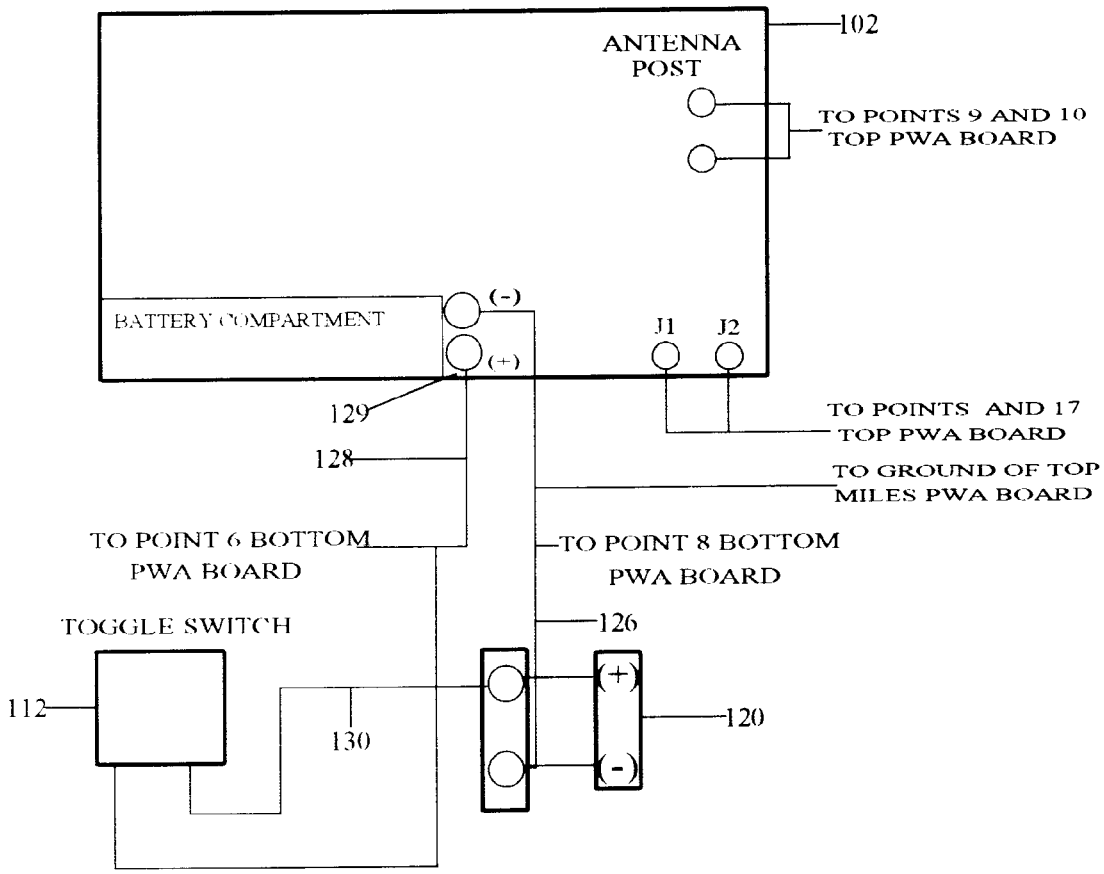
FIG. 8 is a plan view detailing additional circuitry contained within the enclosure of FIG. 6.

All modifications to the MILES gear were done within the MILES electronics box 102. The existing MILES electronics box 102 was placed within a larger enclosure 110 as is shown in FIG. 6. Three components are added to the MILES, a 12 vdc relay K1 with both normally open and normally closed contacts, a heavy duty on/off toggle switch 112, a 4 pin cannon connector 114, which is secured to the enclosure 110.

Each of the three components performs a discreet function. K1 is used to sense and simulate a "Hit" condition in the MILES circuitry and send that information to the PITS, DARTS, and ERETS targets via the target mechanism's hit sensor connection. The heavy duty on/off toggle switch 112 is used to conserve the 9 volt battery 120. The 4 pin cannon connector 114 serves as a link between the modified MILES harness and the hit sensor connector on the target lifting mechanism.

The following is a detailed description of the electronic connections made to the MILES electronics box. The electronics box is detached from the MILES harness, and the following connections are remade.

1. The harness buzzer wire was replaced by the coil of K1 at points 7 and 8 of the top PWA board 122.
2. The reset key wire was replaced by a jumper wire 124 from point 3 to ground on the top PWA board 122.
3. The normally open contacts of K1 are connected to pins A and B of the 4 pin cannon connector 114. The normally closed contacts of K1 are connected to pins C and D of the 4 pin cannon connector 114.
4. A jumper wire 126 from the negative battery post of the MILES electronics box is connected to ground of the top PWA board and to the negative side of the 9 volt battery 120.
5. A jumper wire 128 from the positive battery post 129 of the MILES electronics box 102 is connected to the heavy duty on/off toggle switch 112.
6. The positive side of the 9 volt battery is connected to the heavy duty on/off toggle switch via wire 130.

The coil of K1 is connected across the same connection, pins 7 and 8 of the top pwa board 122, as those of the annunciator 104. Under normal conditions the voltage across these pins is 0 vdc. When the MILES harness senses a "hit", the voltage rises to 9 vdc and energizes the coil of K1 and closes its normally open contacts and opens the normally closed contacts. The normally open contacts are connected to A and B of a 4 pin cannon connector 114. The normally closed contacts are connected to C and D of the same 4 pin cannon connector 114. The closing or opening of these contacts electrically simulates a "hit" from the hit sensor 101. This "hit" information is sent to the various target lifting mechanisms via the 4 pin cannon connector 114.

A jumper 124 from point 3 on the top PWA board 122 to ground is used in place of a controller key to reset the MILES infantry harness after each hit and concealment. When the target mechanism receives the proper MILES code, the modified MILES equipment of the present invention sends a signal to the target lifting mechanism's hit sensor which causes the target arm to rotate 90 degrees into the concealed position, the target silhouette then pauses and returns to the vertical position. The target may be engaged repeatedly until the predetermined number of hits is achieved on the target lifting mechanisms controller thereby leaving the target silhouette in the horizontal position.

Laser Hostile Fire Simulator

Both of the above mentioned systems can be further modified to include the ability to "return fire" using a MILES Small Arms Transmitter (SAT). The SAT is mounted on the silhouette or mounted separately as a "stand alone system" in such a manner that its field of fire is adjustable within 180 degrees both horizontally and vertically. The SAT will be further modified to allow for weapons type and rate of fire selection. The SAT can be triggered to fire by a multiplicity of external sensing devices such as motion, thermal, and audio detectors.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

1. A method of integrating a live fire target mechanism with a laser fire training system, said live fire target mechanism having a target actuating mechanism for raising and lowering a target, a vibration type hit sensor, and a first hit signal generating means electrically connected to said target actuating mechanism; said laser fire training system being portable and having a plurality of optical sensors and a second hit signal generating means connected thereto, said method comprising the steps of:

electrically disconnecting said first hit signal generating means from said target actuating mechanism;

attaching said laser fire training system to said live fire target mechanism;

connecting said target actuating mechanism to receive signals from said second hit signal generating means; and, electrically connecting said second hit signal generating means to said target actuating mechanism.

2. The method of claim 1 wherein said laser fire training system is a MILES system and said second hit signal is generated upon receipt of MILES laser code.

* * * * *